US007628503B1

(12) United States Patent
Pumm

(10) Patent No.: US 7,628,503 B1
(45) Date of Patent: Dec. 8, 2009

(54) ILLUMINATED KEY CASING ASSEMBLY

(76) Inventor: Kevin M. Pumm, 8593 Colonial La., Ladue, MO (US) 63124

( * ) Notice: Subject to any disclaimer, the term of this patent is extended or adjusted under 35 U.S.C. 154(b) by 0 days.

(21) Appl. No.: 12/398,024

(22) Filed: Mar. 4, 2009

(51) Int. Cl.
*F21V 33/00* (2006.01)

(52) U.S. Cl. ..... 362/116; 362/109; 362/119; 362/223; 362/577; 362/578; 362/579; 362/800

(58) Field of Classification Search ..... 362/109, 362/116, 119, 223, 577, 578, 579, 800
See application file for complete search history.

(56) References Cited

U.S. PATENT DOCUMENTS

| | | | | |
|---|---|---|---|---|
| 4,276,582 | A * | 6/1981 | Burnett | 362/116 |
| 4,521,833 | A * | 6/1985 | Wolter | 362/116 |
| 4,562,712 | A * | 1/1986 | Wolter | 70/456 R |
| 5,515,248 | A * | 5/1996 | Canfield et al. | 362/116 |
| 5,541,817 | A | 7/1996 | Hung | 362/116 |
| 5,730,013 | A | 3/1998 | Huang | 70/395 |
| 6,132,058 | A | 10/2000 | Kuo | 362/116 |
| 6,182,484 | B1 | 2/2001 | Wolter | 70/395 |
| 6,224,228 | B1 | 5/2001 | Fredrick | 362/116 |
| 6,626,019 | B1 * | 9/2003 | Huang | 70/456 R |
| 6,651,470 | B1 * | 11/2003 | Rafter | 70/395 |
| 7,018,064 | B2 * | 3/2006 | Galli | 362/200 |
| 7,036,950 | B1 | 5/2006 | Freeman et al. | 362/100 |
| 7,159,993 | B1 | 1/2007 | Lu et al. | 362/116 |
| 2007/0159811 | A1 | 7/2007 | Chen | 362/116 |

FOREIGN PATENT DOCUMENTS

| | | |
|---|---|---|
| GB | 2039321 | 8/1980 |
| GB | 2431430 | 4/2007 |

* cited by examiner

*Primary Examiner*—Sharon E. Payne
*Assistant Examiner*—Mary Zettl

(57) ABSTRACT

An illuminated key casing assembly includes a light transmissive casing having a top and bottom side, a key ring hole, and a slot between the top and bottom side extending to the key ring hole that is configured to receive a key. The light transmissive casing includes a first cavity holding a single battery, and a second cavity that receives a light emitting device. Disposed between the first and second cavities are first and second protrusions, wherein light that is transmitted from within the second cavity through the first protrusion is dispersed through the light transmissive casing. The second protrusion has a mounting hole and an arcuate-shaped slot. The light emitting device has a first leadwire force-fit between a sidewall of the first cavity and battery so as to secure the battery, and a second leadwire received within the arcuate-shaped slot to provide a free end positioned over and spaced apart from the battery. A cover is further provided.

20 Claims, 3 Drawing Sheets

ILLUMINATED KEY CASING ASSEMBLY

FIELD

The present disclosure relates to lighting devices, and more specifically, to an illuminated key casing for a key for aiding in opening a lock under insufficient lighting.

BACKGROUND

This section provides background information related to the present disclosure which is not necessarily prior art.

Keys may be difficult to insert into a lock under dim lighting conditions. Several attempts have been made to provide a light source on a customized key blank to provide a key that can illuminate a lock under dim lighting conditions. For example, U.S. Pat. No. 4,521,833 to Wolter, U.S. Pat. No. 5,541,817 to Hung, and U.S. Pat. No. 5,730,013 to Huang all describe complex designs in which the shank of the key or the head of the key are of a custom design that must be cut by a locksmith to fit the owner's lock. None of these designs contemplate fitting an illumination means to an existing key that is already cut and currently being used by an owner in connection with an associated lock.

SUMMARY

This section provides a general summary of the disclosure, and is not a comprehensive disclosure of its full scope or all of its features. The present disclosure relates to an illuminated key casing assembly for use with an existing key that is already cut and currently being used by an owner. According to one aspect of the present disclosure, one embodiment of an illuminated key casing assembly is provided that includes a light transmissive casing made of a translucent material, the light transmissive casing having a generally circular shape with a top side, a bottom side, a key ring hole extending through from the top side to the bottom side of the light transmissive casing, and a slot disposed between the top side and the bottom side that extends to the key ring hole. The slot is configured to receive a grip-end portion of a key therein, wherein the key ring hole is positioned on the side of the light transmissive casing opposite an open end of the slot so as to align with an opening in the grip-end portion of a key that is received within the slot. The light transmissive casing further comprises an interior portion that includes a first cavity and a second cavity. The first cavity is disposed in the top side of the light transmissive casing, and is configured to receive a single battery therein. The second cavity is disposed in the top side proximate the center of the circular-shape of the light transmissive casing, and is configured to receive a light emitting device therein, the second cavity having a bottom surface therein. The second cavity is disposed directly above the slot that is configured to receive the grip-end portion of a key therein such that light that is transmitted from within the second cavity through the bottom surface of the second cavity and to the slot is reflected off a surface of a grip-end of a key that is received within the slot, to further disperse said light in light transmissive casing. The light transmissive casing includes a recessed surface in the top side of the light transmissive casing that extends around at least a portion of the first cavity and the second cavity, and a first protrusion and a second protrusion. The first protrusion is disposed between the first cavity and the second cavity, wherein light that is transmitted from within the second cavity through the first protrusion is dispersed by the protrusion through the light transmissive casing. The second protrusion is disposed between the first cavity and the second cavity, the second protrusion having a mounting hole therein that is configured to receive a fastener, and an arcuate-shaped wire slot disposed in the second protrusion between the first cavity and the second cavity. The illuminated key casing assembly includes a single battery disposed in the first cavity, the single battery having a first battery terminal on at least a side portion of the single battery and a second battery terminal on a top portion of the single battery. The illuminated key casing assembly includes a light emitting device disposed within the second cavity in the light transmissive casing such that the light emitting device is completely enclosed within the interior portion of the light transmissive casing, the light emitting device having a first electrical leadwire and a second electrical leadwire. The first electrical leadwire is force-fit between an annular sidewall of the first cavity and the single battery disposed within the first cavity so as to wedge the single battery within the first cavity, to secure and prevent movement of the single battery within the first cavity and to further establish electrical contact with the first battery terminal. The second electrical leadwire is received within the arcuate-shaped wire slot in the second protrusion, and a free end of the second electrical leadwire extends in a cantilevered manner to a first position in which the end of the second electrical leadwire is positioned over the top of the single battery so as to be spaced apart from the second battery terminal. The illuminated key casing assembly includes a cover disposed on the recessed surface and covering the first cavity and the second cavity such that the light emitting device is completely enclosed within the interior portion of the light transmissive casing. The cover abuts the second protrusion on the light transmissive casing so as to entrap the second electrical leadwire between the cover and the light transmissive casing and rigidly secure the second electrical leadwire within the arcuate-shaped wire slot in the second protrusion. The cover further includes a U-shaped slot having first and second ends, and a fastener hole that is positioned approximately at an equal distance from both the first and second ends of the U-shaped slot so as to define an area of weakness about which a deflecting portion within the U-shaped slot is configured to be selectively depressed and deflected inwardly to push the free end of the second electrical leadwire into electrical contact with the second battery terminal. The deflecting portion pushed the free end of the second electrical leadwire so as to momentarily establish electrical connection between the second battery terminal and the second electrical leadwire of the light emitting device, to thereby turn on the light emitting device and illuminate the light transmissive casing. The fastener hole is aligned with the mounting hole in the second protrusion when the cover is disposed on the recessed surface and covering the first cavity and the second cavity. The illuminated key casing assembly further includes a fastener that is configured to be received within the mounting hole for securing the cover relative to the light transmissive casing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Figure 1:
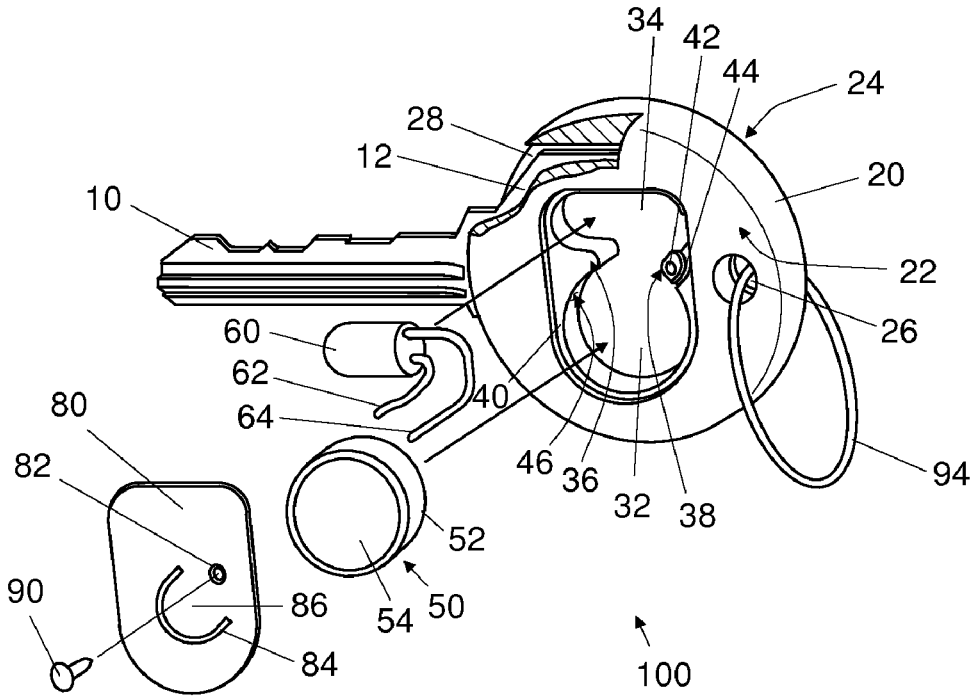
FIG. 1 shows an exploded assembly side elevation view of one embodiment of an illuminated key casing assembly, in accordance with the principles of the present disclosure.

In the various embodiments, an illuminated key casing assembly is provided that may be selectively illuminated by a user, for improving visibility during use of the key in dimly lit areas. Referring to FIG. 1, an illuminated key casing assembly 100 is shown that is configured to receive a key 10 therein. The illuminated key casing assembly 100 is configured to receive a key 10 therein, and may be selectively illuminated by a user for improving visibility during use of the key 10. The illuminated key casing assembly 100 includes a light transmissive casing 20 that has a generally circular shape and is made of a translucent material. The light transmissive casing 20 is preferably made of a translucent or transparent material, such as a clear acrylic, or clear plastic material. The light transmissive casing 20 has a top side 22, a bottom side 24, a key ring hole 26 extending through from the top side 22 to the bottom side 24 of the light transmissive casing 20, and a slot 28 disposed between the top side 22 and the bottom side 24 that extends to the key ring hole 26. The slot 28 is configured to receive a grip-end portion 12 of a key 10 within an open end of the slot, wherein the key ring hole 26 is positioned on the side of the light transmissive casing 20 opposite the open end of the slot 28 so as to align with an opening in the grip-end portion 12 of a key 10 received within the slot 28. The light transmissive casing 20 further includes a first cavity 32 configured to receive a single battery 50 therein, and a second cavity 34 configured to receive a light emitting device 60 therein. The second cavity 34 is disposed in the top side 22 of the light transmissive casing 20 near the center of the circular-shape of the light transmissive casing. The second cavity 34 has a bottom surface that is disposed directly above the slot 28 configured to receive a key, such that any light transmitted from within the second cavity 34 through the bottom surface is reflected off of the surface of a key within the slot 28, to thereby disperse light within the light transmissive casing 20. The light transmissive casing 20 further includes a first protrusion 36 disposed between the first cavity 32 and the second cavity 34, and a second protrusion 38 disposed between the first cavity 32 and the second cavity 34. The light transmissive casing 20 has a recessed surface 40 in the top side 22 of the light transmissive casing 20 that extends around at least a portion of the first cavity 32 and the second cavity 34. The second protrusion 38 has a mounting hole 42 therein that is configured to receive a fastener 90, and has an arcuate-shaped wire slot 44 therein. The arcuate-shaped wire slot extends across the second protrusion 38 from the first cavity 32 to the second cavity 34.

The illuminated key casing assembly 100 includes a single battery 50 that has a first battery terminal 52 on at least a side portion of the single battery 50, and a second battery terminal 54 on a top portion of the single battery 50. The single battery 50 is preferably a button battery configured to provide a voltage of about 3.0 volts, and may be a Cr 1025 GI lithium battery sold by Global Batteries of Brooklyn, N.Y. The illuminated key casing assembly 100 includes a light emitting device 60 having a first electrical leadwire 62, or "anode" electrical leadwire, and a second electrical leadwire 64, or "cathode" electrical leadwire. The second electrical leadwire 64 is received within the arcuate shaped wire slot 44 in the second protrusion 38 and extends in a cantilevered manner beyond the second protrusion 38 to a first position in which the second electrical leadwire 64 is positioned over and spaced apart from the top of the single battery 50. The light emitting device 60 is preferably a light emitting diode (LED) configured to be illuminated by application of a voltage of at least 1.5 volts to the cathode terminal of the light emitting device 60. More preferably, the light emitting device is a T1 light emitting diode having a maximum forward voltage of 1.8 to 3.0 volts and a forward current of 30 milliamps, and may be an LED UT6371-41-M1 manufactured by Ledtech, for example. A cover 80 is provided that includes a fastener hole 82 and a deflecting portion 86 within a U-shaped slot 84, which is configured to be depressed and deflected inwardly to push a free end of the second electrical leadwire 64 into electrical contact with the second battery terminal 54 of the single battery 50. A fastener 90 is provided for securing the cover 80 to the mounting hole 42 in the light transmissive casing 20. In the preferred embodiment, the fastener 90 is a metric screw M1.8 screw, but the fastener may alternatively comprise any other screw, rivet, plug or any suitable fastener component.

Figure 2:
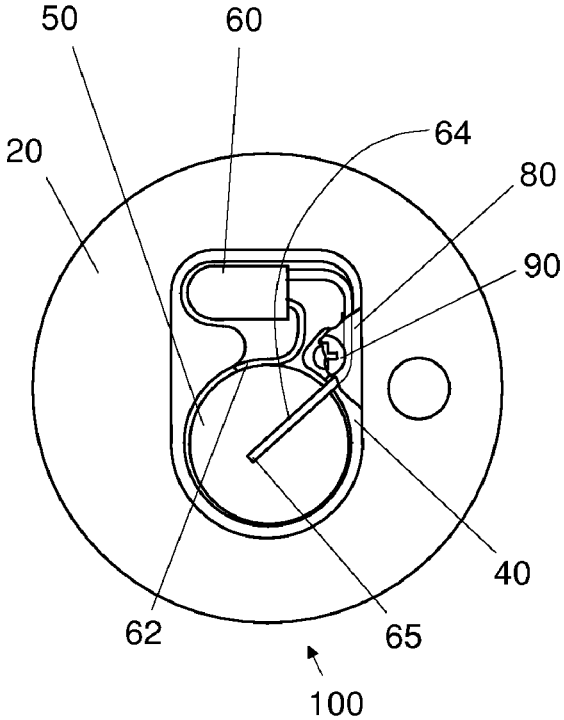
FIG. 2 shows a cut-away view of the illuminated key casing assembly shown in FIG. 1, with a portion of the cover cut-away for illustration purposes.

Referring to FIG. 2, a cut-away view of the illuminated key casing assembly 100 is shown with a portion of the cover 80 and fastener 90 cut-away. As shown in FIG. 2, the light emitting device 60 has a first electrical leadwire 62 that is force-fit between an annular sidewall 46 of the first cavity 32 and the single battery 50 disposed within the first cavity 32, so as to wedge the single battery 50 in place within the first cavity 32, to secure and prevent movement of the single battery 50 within the first cavity 32 and to further establish electrical contact with the first battery terminal 52. The second electrical leadwire 64 is received within an arcuate-shaped wire slot 44 in the second protrusion 38. A free end 65 of the second electrical leadwire 64 extends in a cantilevered manner to a first position in which the end of the second electrical leadwire 64 is positioned over the top of the single battery 50, so as to be spaced apart from the second battery terminal 54.

Because the free end 65 of the second electrical leadwire is intended to be deflected, the second electrical leadwire 64 has a stiffness that is sufficient to restore the free end 65 of the second electrical leadwire 64 to the first position in which the free end 65 is spaced apart from the second battery terminal 54. The measure of stiffness of a length of rod or shaft is the ratio of the load P verses the deflection δ for the rod, and is typically expressed as:

$$\text{Stiffness}=P/\delta,$$

where $\delta=Pl^3/3\,EI$, and E is the modulus of elasticity.

In the preferred embodiment, the second electrical leadwire 64 has a square cross-section, for which the cross-sectional inertia, I, is expressed as:

$$I=bh^3/12,$$

where b is the base and h is the height of the rod. Thus, the stiffness for the second electrical leadwire 64 may be expressed as:

$$K=Ebh^3/4\,l^3$$

In the preferred embodiment, the second electrical leadwire 64 is a copper wire having a square cross-section with a base of 0.5 millimeters and a height of 0.5 millimeters, and a modulus of elasticity of $11.7\times10^7$ killipascal. Preferably, the second electrical leadwire 64 disposed within the arcuate-shaped wire slot 44 has a length, $l$, of less than about 13 millimeters, and more preferably less than about 10 millimeters that is cantilevered beyond the arcuate-shaped wire slot 44. With second electrical leadwire 64 having a length of 10 millimeters from the arcuate-shaped wire slot 44 to the free end 65, and a base of 0.5 millimeters and a height of 0.5 millimeters, the second electrical leadwire 64 has a stiffness of at least 1.82 killipascal that is sufficient for restoring the free end 65 of the second electrical leadwire 64 to the first position spaced apart from the second battery terminal 54. The second electrical leadwire 64 preferably has an inertial cross-section of at least $5.2\times10^{-19}$ meters$^4$, to provide a sufficient resistance to a bending moment for enabling the restoration of the free end 65 of the second electrical leadwire 64 to the first position spaced apart from the second battery terminal 54.

Figure 3:
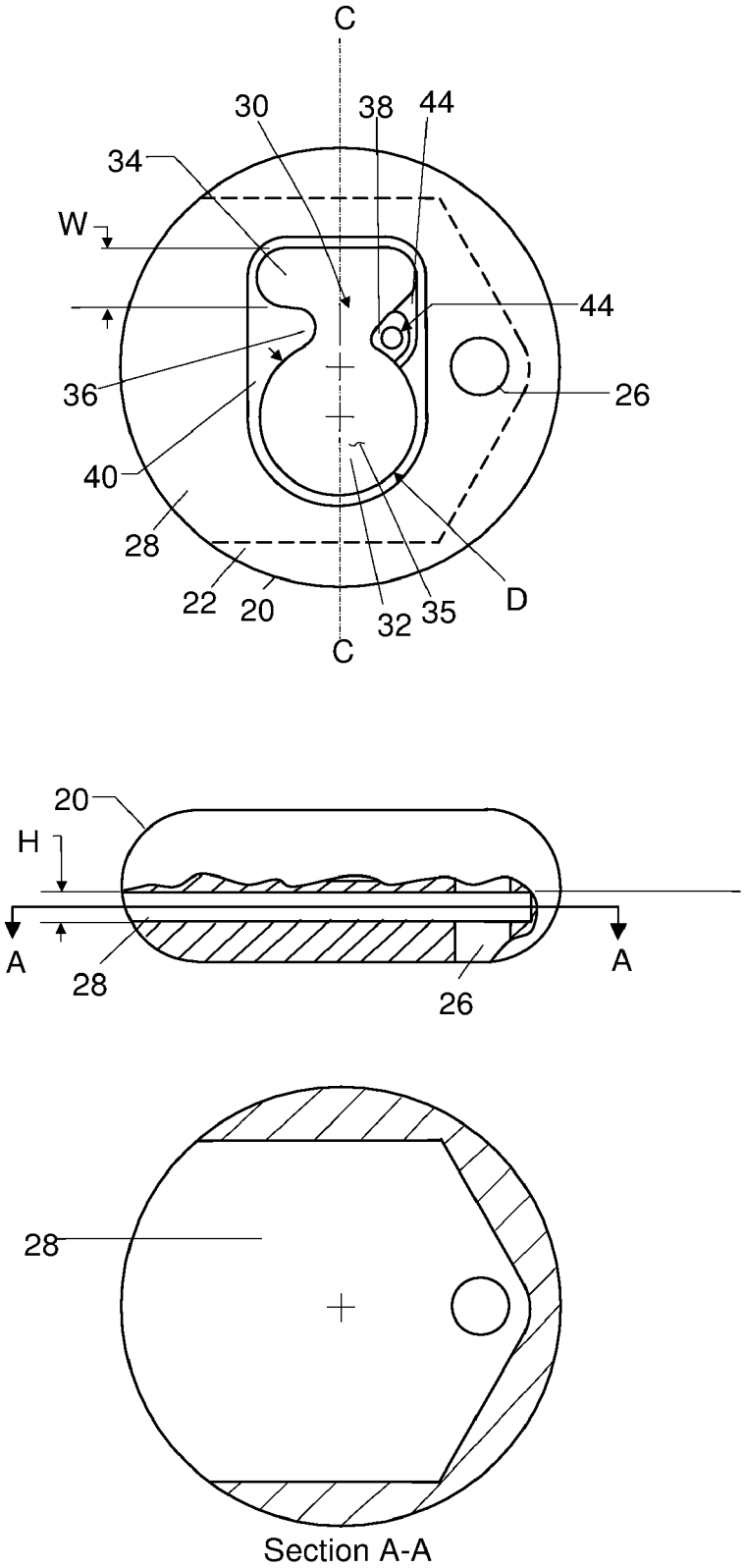
FIG. 3 shows an embodiment of a light transmissive casing for the illuminated key casing assembly shown in FIG. 1.

Referring to FIG. 3, the light transmissive casing 20 is shown in more detail. As stated above, the light transmissive casing 20 is made of a translucent material, and has a generally circular shape with a top side 22, a bottom side (not shown in FIG. 3) a key ring hole 26 extending through from the top side 22 to the bottom side of the light transmissive casing 20, and a slot 28 disposed between the top side 22 and the bottom side that extends to the key ring hole 26. The slot 28 has an opening height H that sized such that the slot 28 is configured to snugly receive a grip-end portion 12 of a key 10 therein (as shown in FIG. 1). The key ring hole 26 is positioned on the side of the light transmissive casing 20 opposite an open end of the slot 28, so as to align with an opening in the grip-end portion of a key 10 that is received within the slot 28. The light transmissive casing 20 further comprises an interior portion 30 that includes a first cavity 32 and a second cavity 34. The first cavity 32 is disposed in the top side 22 of the light transmissive casing 20, and has a diameter D that is sized no more than 0.5 millimeters greater than the diameter of the single battery, such that the first cavity 32 is configured to snugly receive the single battery 50 therein (as shown in FIG. 2). The light transmissive casing 20 further includes a second cavity 34 that is disposed in the top side 22 proximate the center line "C" of the circular-shape of the light transmissive casing 20, as shown in FIG. 3. The second cavity 34 has a width W that is sized such that the second cavity 34 is configured to receive a light emitting device 60 therein, as shown in FIG. 2. The second cavity 34 opens into and adjoins the first cavity 32, and has a bottom surface 35 therein. The second cavity 34 is also disposed directly above the slot 28 that is configured to receive the grip-end portion 12 of a key 10 (as shown in FIG. 1), such that light that is transmitted from within the second cavity 34 through the bottom surface 35 of the second cavity 34 and to the slot 28 is reflected off a surface of a grip-end of a key that is received within the slot 28, to further disperse light in the light transmissive casing 20. The light transmissive casing 20 further includes a recessed surface 40 in the top side 22 of the light transmissive casing 20 that extends around at least a portion of the first cavity 32 and the second cavity 34. The light transmissive casing 20 further includes a first protrusion 36 disposed between the first cavity 32 and the second cavity 34. It has been found that when the light transmissive casing 20 does not include a first protrusion 36 between the first cavity 32 and the second cavity 34, and light is transmitted from within the second cavity 32, the result is that more light is transmitted through the light transmissive casing 20 to an area external to and outside of the light transmissive casing 20, which establishes a small "pin-point" area of illumination in front of the key. It has also been found that when light is emitted within and transmitted from the second cavity 32 through the first protrusion 36 (which is angled and converging towards the center of the casing), the first protrusion 36 acts like a prism and disperses light through out the light transmissive casing 20. This results in greater dispersion of light to establish a greater area of illumination surrounding the key, to thereby improve overall visibility. The light transmissive casing 20 further includes a second protrusion 38 disposed between the first cavity 32 and the second cavity 34. The second protrusion 38 has a mounting hole 42 therein that is configured to receive a fastener 90 (as shown in FIG. 2). The second protrusion 38, which extends from the recessed surface 40, further includes an arcuate-shaped wire slot 44, which is disposed in the second protrusion 38 between the first cavity 32 and the second cavity 34. A light emitting device 60 is inserted within the second cavity 34 in the light transmissive casing 20 such that the light emitting device 60 is completely enclosed within the interior portion 30 of the light transmissive casing 20.

The first protrusion 36 in the light transmissive casing 20 has a first side 46 facing the first cavity 32 and a second side facing the second cavity 34, wherein the first side 46 is at an angle relative to the second side such that the first and second sides converge towards the center region of the circular-shape of the light transmissive casing 20, to thereby form a generally prism-shaped section such that light transmitted from within the second cavity 34 though the first protrusion 36 is dispersed throughout the light transmissive casing 20. The second protrusion 38 also has opposing sides that converge towards the center region of the light transmissive casing 20, to form a generally prism-shaped section for causing dispersion of light throughout the light transmissive casing 20.

Figure 4:
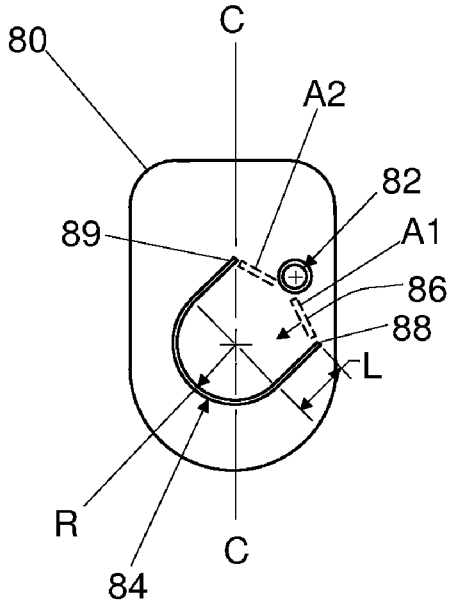
FIG. 4 shows a top elevation view of an embodiment of a cover for the illuminated key casing assembly shown in FIG. 1.

Referring to FIG. 4, a cover 80 is shown. The cover 80 may be configured to be light transmissive, and may be made of a translucent or transparent material, such as a clear acrylic, or clear plastic. When assembled as shown in FIG. 2, the cover 80 is disposed on the recessed surface 40 of the light transmissive casing 20, covering the first cavity 32 and the second cavity 34 such that the light emitting device 60 is completely enclosed within the interior portion 30 of the light transmissive casing 20. The cover 80 also abuts the second protrusion 38 on the light transmissive casing 20 so as to entrap the second electrical leadwire 64 between the cover 80 and the light transmissive casing 20. The cover 80 accordingly rigidly secures the second electrical leadwire 64 within the arcuate-shaped wire slot 44 in the second protrusion 38. As shown in FIG. 4, the cover 80 further includes a U-shaped slot 84 having a first end 88 and a second end 89, and a fastener hole 86 that is positioned approximately at an equal distance from both the first end 88 and from the second end 89 of the U-shaped slot 84, so as to define an area of weakness about which a deflecting portion 86 within the U-shaped slot 84 is configured to be selectively depressed and deflected inwardly to push the free end 65 of the second electrical leadwire 64 into electrical contact with the second battery terminal 54, so as to momentarily establish electrical connection between the second battery terminal 54 and the second electrical leadwire 64 of the light emitting device 60, to thereby turn on the light emitting device 60 and illuminate the light transmissive casing 20. The cover 80 further includes a fastener hole 82 that is aligned with the mounting hole 42 in the second protrusion 38 when the cover 80 is disposed on the recessed surface 40 and covering the first cavity 32 and the second cavity 34 as shown in FIG. 2.

The cover 80 has a fastener hole 82 that is positioned approximately midway between the first and second ends 88, 89 of the U-shaped slot 84, so as to define a first cross-sectional area A1 between the fastener hole 82 and the first end 88 of the U-shaped slot 84, and a second cross-sectional area A2 between the fastener hole 82 and the second end 89 of the U-shaped slot 84. The first cross-sectional area A1 and second cross-sectional area A2 together are less than a cross-sectional area that lies between the first and second ends 88, 89 of the U-shaped slot 84, such that the first and second cross-sectional areas A1 and A2 define an area of weakness about which the deflecting portion 86 within the U-shaped slot 84 is configured to be deflected inwardly towards the second battery terminal 54 of the single battery 50.

Figure 5:
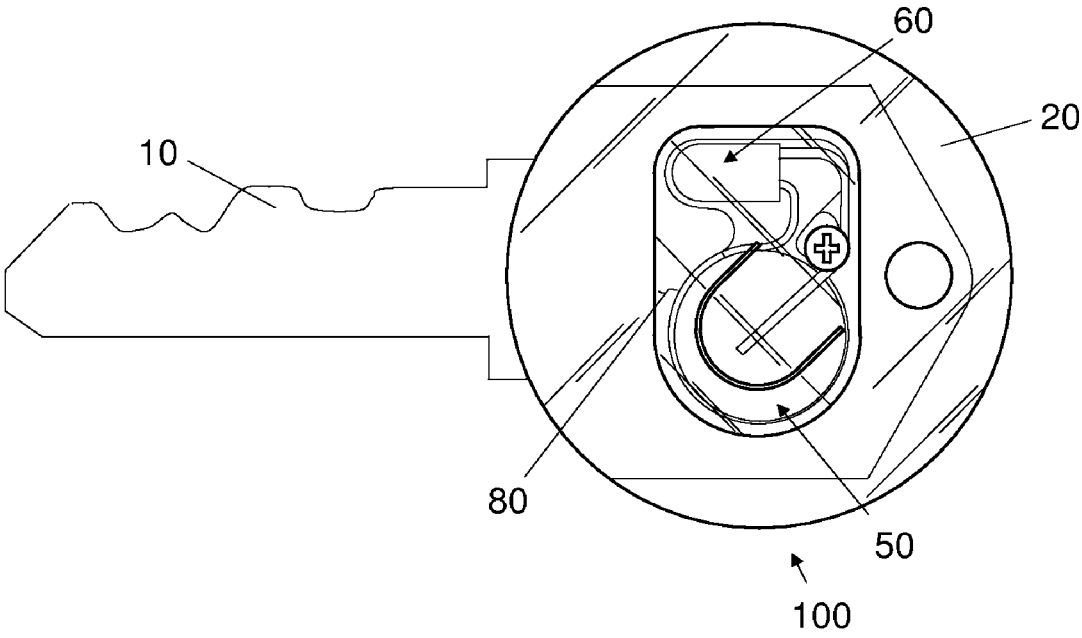
FIG. 5 shows a top elevation view of the assembled illuminated key casing shown in FIG. 1, in accordance with the principles of the present disclosure.

Referring to FIG. 5, an assembled illuminated key casing assembly 100 is shown. In the illuminated key casing assembly 100, the light emitting device 60 is enclosed within the light transmissive casing 20 beneath the cover 80 such that no part of the light emitting device 60 is external to the light transmissive casing 20 or the illuminated key casing assembly. Accordingly, light emitted from the light emitting device 60 is only transmitted to an area outside of the illuminated key casing assembly 100 through the light transmissive casing 20 and the cover 80. As depicted in FIG. 5, the light transmissive casing 20 is made of a material that is one of an optically translucent material or an optically transparent material, such that light emitted by the light emitting device 60 is dispersed through the light transmissive casing 20 so that the entire light transmissive casing 20 has an effect of being illuminated.

As shown in FIG. 1, the illuminated key casing assembly may further include a key ring 94 received within the key ring hole 26, wherein the key ring 94 and slot 28 are configured to retain a grip-end portion 12 of a key 10 that is received within the slot 28 by extending though an opening in the grip-end portion of a key 10 that is aligned with the key ring hole 26. In the illuminated key casing assembly 100 shown in FIGS. 1-5, the single battery 50, the light emitting device 60, and the first and second electrical leadwires 62 and 64 are enclosed within the interior portion 30 of the light transmissive casing 20, such that a grip-end portion 12 of a key 10 that is received within the slot 28 is electrically isolated from the single battery 50, the light emitting device 60 and the first and second electrical leadwires 62 and 64.

Accordingly, the illuminated key casing assembly 100 provides the new useful function of a light transmissive casing made of a translucent material, having a generally circular shape with a key ring hole extending from a top side to a bottom side of the light transmissive casing, and a slot for a key disposed between the top side and the bottom side that extends to the key ring hole, which is configured to receive an existing key that is already cut, unlike other prior art devices.

The illuminated key casing assembly 100 includes the novel feature of a first protrusion disposed between the first cavity and the second cavity, wherein light that is transmitted from within the second cavity through the first protrusion is dispersed by the first protrusion through the light transmissive casing. The illuminated key casing assembly 100 further includes the novel feature of a second protrusion disposed between the first cavity and the second cavity, where the second protrusion has a mounting hole therein that is configured to receive a fastener, and an arcuate-shaped wire slot disposed in the second protrusion between the first and second cavities.

The illuminated key casing assembly 100 provides an improvement over prior art attempts by providing a light transmissive casing 20 that includes the novel feature of a second cavity 34 that is configured to receive a light emitting device 60 therein, wherein the second cavity 34 is disposed in the top side 22 proximate the center C of the circular-shape of the light transmissive casing 20, and is further disposed directly above a slot 28 configured to receive a grip-end portion of a key 10 therein, such that light transmitted from within the second cavity 34 through the light transmissive casing 20 into the slot 28 is reflected off the surface of a grip-end 12 of a key 10 that is received within the slot 28, to further disperse light in the light transmissive casing. The illuminated key casing assembly 100 provides a further improvement over prior art devices by providing a light transmissive casing 20 having a first cavity 32 with a diameter D that is no more than 0.5 millimeters greater than the diameter of the single battery 50 such that the single battery 50 is snugly disposed within the first cavity 32 and the second electrical leadwire 64 force-fit between the first cavity sidewall 46 and the single battery 50 wedges the single battery 50 within the first cavity 32 to secure the single battery therein.

The illuminated key casing assembly 100 also includes another improvement over prior art devices, in providing a light transmissive casing 20 having an arcuate-shaped wire slot 44, and an second electrical leadwire 64 disposed in the arcuate shaped slot 44, and a cover 80 abutting the surface of the first protrusion having the arcuate-shaped wire slot 44 so as to entrap the second electrical leadwire 64 between the cover 80 and the light transmissive casing 20, to rigidly secure the second electrical leadwire 64 within the arcuate-shaped wire slot 44 in the light transmissive casing 20. The illuminated key casing assembly 100 provides an improvement over prior art attempts by providing a second electrical leadwire 64 that extends in a cantilevered manner from the arcuate-shaped wire slot 44 to a first position in which a free end 65 of the second electrical leadwire 64 is positioned over the single battery 50 so as to be spaced apart from the second battery terminal 54, and a cover 80 with a U-shaped slot 84 defining a deflecting portion 86 that is configured to be selectively depressed and deflected inwardly to push the free end 65 of the second electrical leadwire 64 into electrical contact with the second battery terminal 54. Moreover, the illuminated key casing assembly 100 includes a novel cover 80 having a fastener hole 82 that is positioned approximately at an equal distance from both the first and second ends 88, 89 of the U-shaped slot 84 so as to define an area of weakness about which a deflecting portion 86 within the U-shaped slot 84 is configured to be selectively depressed and deflected inwardly to push the free end 65 of the second electrical leadwire 64 into electrical contact with the second battery terminal 54. Additionally, the prior art devices do not include the novel feature of the present assembly, of a light emitting device 60 with a first electrical leadwire that is force-fit between an annular sidewall 46 of the first cavity 32 and the single battery 50 disposed within the first cavity 32, so as to wedge the single battery 50 within the first cavity 32 to prevent movement of the single battery 50 within the first cavity 32. The illuminated key casing assembly 100 provides the novel feature of providing a light emitting device 60 disposed within a second cavity 34 in a light transmissive casing 20, wherein the light emitting device 60 is enclosed within the light transmissive casing 20 beneath a cover 80 such that no part of the light emitting device 60 is external to the light transmissive casing 20, and the light emitting device 60 is disposed within the second cavity 34 proximate the center C of the circular-shape of the light transmissive casing 20 such that light emitted from the light emitting device is not transmitted directly to an area outside of the illuminated key casing assembly 100 but instead is dispersed throughout the light transmissive casing 20 and only transmitted to an area outside of the illuminated key casing assembly 100 through the light transmissive casing 20 and/or cover 80.

The illuminated key casing assembly 100 further includes the novel features of a first protrusion 36 disposed between a first cavity 32 and second cavity 34 of a light transmissive casing 20, wherein the first protrusion 36 has a first side 46 facing the first cavity 32 and a second side facing the second cavity 34, wherein the first side 46 is at an angle relative to the second side such that the first and second sides converge towards the center region of the circular-shape of the light transmissive casing 20, to thereby form a generally prism-shaped section such that light transmitted from within the second cavity 34 though the first protrusion 36 is dispersed throughout the light transmissive casing 20. Likewise, the second protrusion has opposing sides that converge towards the center of the light transmissive casing 20 to form a prism-like shape for causing dispersion of light throughout the light transmissive casing 20.

The cover 80 and second electrical leadwire 64 of the illuminated key casing assembly 100 were specifically designed to include critical features that were designed through considerable development and testing, which include the U-shaped slot 84 defining a deflecting portion 86 and the cantilevered length of the second electrical leadwire 64. Specifically, the U-shaped slot 84 has first and second ends 88, 89 which extend a specific length, L, of at least about 3.6 millimeters from a portion defined by radius R. The cover 80 was also specifically designed to include a fastener hole 82 positioned approximately midway between the first and second ends 88, 89 of the U-shaped slot 84 so as to define a first cross-sectional area A1 between the fastener hole 82 and the first end 88 of the U-shaped slot 84, and a second cross-sectional area A2 between the fastener hole 82 and the second end 89 of the U-shaped slot 84, whereby the first cross-sectional area and second cross-sectional area together are less than the cross-sectional area between the first and second ends 88, 89 of the U-shaped slot 84 to thereby define an area of weakness about which the deflecting portion 86 within the U-shaped slot 84 is configured to be deflected inwardly towards the second battery terminal 54 of the single battery 50. The second electrical leadwire was specifically designed to have a second electrical leadwire 64 disposed within an arcuate-shaped wire slot 44 that has a length of less than 10 millimeters extending beyond the end of the arcuate-shaped wire slot 44, such that the free end 65 is cantilevered beyond the arcuate-shaped wire slot 44 and end portion of the second electrical leadwire 64 has a stiffness of at least 1.82 killipascal that is sufficient for restoring the free end 65 of the second electrical leadwire 64 to the first position spaced apart from the second battery terminal 54 once a user has released the deflecting portion 84. Below this stiffness, the second electrical leadwire was found to have a less than desirable restoring force. Similarly, the second electrical leadwire has a specific inertial cross-section of at least $5.2\times10^{-19}$ meters$^4$, to provide a sufficient resistance to a bending moment for restoring the free end 65 of the second electrical leadwire 64 to the first position spaced apart from the second battery terminal 54.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An illuminated key casing assembly for receiving a key therein, which may be selectively illuminated for improving visibility during use of the key, comprising:

a light transmissive casing made of a translucent material, the light transmissive casing having a generally circular shape with a top side, a bottom side, a key ring hole extending through the light transmissive casing from the top side to the bottom side, and a slot disposed between the top side and the bottom side that extends to the key ring hole, the slot being configured to receive a grip-end portion of a key within an open end of the slot, wherein the key ring hole is positioned in the light transmissive casing opposite the open end of the slot so as to align with an opening in the grip-end portion of a key that is received within the slot, the light transmissive casing further comprising an interior portion that includes:

a first cavity that is disposed in the top side of the light transmissive casing, and is configured to receive a single battery therein;

a second cavity that is disposed in the top side of the light transmissive casing near the center of the circular shape of the light transmissive casing, the second cavity being configured to receive a light emitting device therein, wherein the second cavity adjoins the first cavity and has a bottom surface disposed directly above the slot that is configured to receive the grip-end portion of a key therein, such that light being transmitted from within the second cavity through the bottom surface and to the slot is reflected off a surface of a key that is received within the slot, to thereby disperse light transmitted from the second cavity throughout the light transmissive casing;

a recessed surface in the top side of the light transmissive casing that extends around at least a portion of the first cavity and the second cavity;

a first protrusion disposed between the first cavity and the second cavity, wherein light that is transmitted from within the second cavity through the first protrusion is dispersed by the protrusion through out the light transmissive casing;

a second protrusion disposed between the first cavity and the second cavity, the second protrusion having a mounting hole therein that is configured to receive a fastener, and an arcuate-shaped wire slot, said arcuate-shaped wire slot extending across the second protrusion from the first cavity to the second cavity;

a single battery disposed in the first cavity, the single battery having a first battery terminal on at least a side portion of the single battery and a second battery terminal on a top portion of the single battery;

a light emitting device disposed within the second cavity in the light transmissive casing such that the light emitting device is completely enclosed within the interior portion of the light transmissive casing, and a light emitting end of the light emitting device is positioned adjacent the first protrusion, such that a portion of light emitted by the light emitting device is transmitted into the first protrusion and dispersed throughout the light transmissive casing, the light emitting device further including a first electrical leadwire and a second electrical leadwire, wherein the first electrical leadwire is force-fit between an annular sidewall of the first cavity and the single battery disposed within the first cavity so as to wedge the single battery within the first cavity, to secure and prevent movement of the single battery within the first cavity and to further establish electrical contact with the first battery terminal, and wherein the second electrical leadwire is received within the arcuate-shaped wire slot in the second protrusion, and a free end of the second electrical leadwire extends in a cantilevered manner beyond the second protrusion to a first position in which the end of the second electrical leadwire is positioned over the top of the single battery so as to be spaced apart from the second battery terminal;

a cover disposed on the recessed surface and covering the first cavity and the second cavity such that the light emitting device is completely enclosed within the interior portion of the light transmissive casing, the cover abutting the second protrusion on the light transmissive casing so as to entrap the second electrical leadwire between the cover and the light transmissive casing and rigidly secure the second electrical leadwire within the arcuate-shaped wire slot in the second protrusion, the cover further including a U-shaped slot having first and second ends, and a fastener hole that is positioned at an approximately equal distance from both the first and second ends of the U-shaped slot so as to define an area of weakness about which a deflecting portion within the U-shaped slot is configured to be selectively depressed and deflected inwardly to push the free end of the second electrical leadwire into electrical contact with the second battery terminal, so as to momentarily establish electrical connection between the second battery terminal and the second electrical leadwire of the light emitting device, to thereby turn on the light emitting device and illuminate the light transmissive casing, wherein the fastener hole in the cover is aligned with the mounting hole in the second protrusion of the light transmissive casing when the cover is disposed on the recessed surface and covering the first cavity and the second cavity; and a fastener that is configured to be received within the mounting hole for securing the cover relative to the light transmissive casing.

2. The assembly of claim 1 wherein the first protrusion disposed between the first cavity and second cavity has a first side facing the first cavity and a second side facing the second cavity, wherein the first side is at an angle relative to the second side such that the first and second sides converge towards the center of the circular-shape of the light transmissive casing, to thereby form a generally prism-like shape such that light transmitted from within the second cavity though the first protrusion is dispersed throughout the light transmissive casing.

3. The assembly of claim 2 wherein the second protrusion disposed between the first cavity and second cavity has opposing sides that converge towards the center of the light transmissive casing to form a generally prism-like shape for causing dispersion of light throughout the light transmissive casing.

4. The assembly of claim 3 wherein the fastener hole is positioned approximately midway between the first and second ends of the U-shaped slot so as to define a first cross-sectional area between the fastener hole and the first end of the U-shaped slot, and a second cross-sectional area between the fastener hole and the second end of the U-shaped slot, whereby the first cross-sectional area and second cross-sectional area together are less than the cross-sectional area between the first and second ends of the U-shaped slot to thereby define an area of weakness about which the deflecting portion within the U-shaped slot is configured to be deflected inwardly towards the second battery terminal of the single battery.

5. The assembly of claim 4 wherein the light emitting device is enclosed within the light transmissive casing beneath the cover such that no part of the light emitting device is external to the light transmissive casing, and light emitted from the light emitting device is only transmitted to an area outside of the key casing assembly through the light transmissive casing and the cover.

6. The assembly of claim 5 wherein the light transmissive casing is made of a material that is one of an optically translucent material or an optically transparent material, such that light emitted by the light emitting device is dispersed through the light transmissive casing so that the entire light transmissive casing has an effect of being illuminated.

7. The assembly of claim 6 further comprising a key ring received within the key ring hole, wherein the key ring and slot are configured to retain a grip-end portion of a key that is received within the slot, by the key ring extending though an opening in the grip-end portion of a key that is aligned with the key ring hole.

8. The assembly of claim 7, wherein the single battery, the light emitting device and the first and second electrical leadwires are enclosed within the interior portion of the light transmissive casing, such that a grip-end portion of a key that is received within the slot is electrically isolated from the single battery, the light emitting device and the first and second electrical leadwires.

9. The assembly of claim 8 wherein the second electrical leadwire disposed within the arcuate-shaped wire slot has a length of less than about 10 millimeters that is cantilevered beyond the arcuate-shaped wire slot, such that the free end portion of the second electrical leadwire has a stiffness of at least 1.82 killipascal that is sufficient for restoring the free end of the second electrical leadwire to the first position spaced apart from the second battery terminal.

10. The assembly of claim 1 herein the single battery is a button battery configured to provide a voltage of about 3.0 volts, and the light emitting device is a light emitting diode configured to be illuminated by application of a voltage of at least 1.5 volts.

11. An illuminated key casing assembly for receiving a key therein, which may be selectively illuminated for improving visibility during use of the key, comprising:

a light transmissive casing made of a translucent material, the light transmissive casing having a generally circular shape with a top side, a bottom side, a key ring hole extending through the light transmissive casing from the top side to the bottom side, and a slot disposed between the top side and the bottom side that extends to the key ring hole, the slot being configured to receive a grip-end portion of a key within an open end of the slot, wherein the key ring hole is positioned in the light transmissive casing opposite the open end of the slot so as to align with an opening in the grip-end portion of a key that is received within the slot, the light transmissive casing further comprising an interior portion that includes:

a first cavity that is disposed in the top side of the light transmissive casing having a diameter that is sized such that the first cavity is configured to snugly receive a single battery therein;

a second cavity that is disposed in the top side of the light transmissive casing near the center of the circular shape of the light transmissive casing, the second cavity being configured to receive a light emitting device therein, wherein the second cavity adjoins the first cavity and has a bottom surface therein, and the second cavity is disposed directly above the slot that is configured to receive the grip-end portion of a key therein, such that light being transmitted from within the second cavity through the bottom surface and to the slot is reflected off a surface of a key that is received within the slot, to thereby disperse light transmitted from the second cavity throughout the light transmissive casing;

a recessed surface in the top side of the light transmissive casing that extends around at least a portion of the first cavity and the second cavity;

a first protrusion disposed between the first cavity and the second cavity, wherein light that is transmitted from within the second cavity through the first protrusion is dispersed by the protrusion throughout the light transmissive casing;

a second protrusion disposed between the first cavity and the second cavity, the second protrusion having a mounting hole therein that is configured to receive a fastener, and an arcuate-shaped wire slot, said arcuate-shaped wire slot extending across the second protrusion from the first cavity to the second cavity;

a single battery disposed in the first cavity and having a diameter of a size such that the single battery is snugly received within the first cavity, the single battery having a first battery terminal on at least a side portion of the battery and a second battery terminal on a top portion of the battery;

a light emitting device disposed within the second cavity in the light transmissive casing such that the light emitting device is completely enclosed within the interior portion of the light transmissive casing, and a light emitting end of the light emitting device is positioned adjacent the first protrusion, such that a portion of light emitted by the light emitting device is transmitted into the first protrusion and dispersed throughout the light transmissive casing, the light emitting device further including a first electrical leadwire and a second electrical leadwire, wherein the first electrical leadwire is force-fit between an annular sidewall of the first cavity and the single battery snugly disposed within the first cavity so as to wedge the single battery within the first cavity, to secure and prevent movement of the single battery within the first cavity and to further establish electrical contact with the first battery terminal, and wherein the second electrical leadwire is received within the arcuate-shaped wire slot in the second protrusion, and a free end of the second electrical leadwire extends in a cantilevered manner beyond the second protrusion to a first position in which the end of the second electrical leadwire is positioned over the top of the single battery so as to be spaced apart from the second battery terminal;

a cover disposed on the recessed surface and covering the first cavity and the second cavity such that the light emitting device is completely enclosed within the interior portion of the light transmissive casing, the cover abutting the second protrusion on the light transmissive casing so as to entrap the second electrical leadwire between the cover and the light transmissive casing and rigidly secure the second electrical leadwire within the arcuate-shaped wire slot in the second protrusion, the cover further including a U-shaped slot having first and second ends, and a fastener hole that is positioned at an approximately equal distance from both the first and second ends of the U-shaped slot so as to define an area of weakness about which a deflecting portion within the U-shaped slot is configured to be selectively depressed and deflected inwardly to push the free end of the second electrical leadwire into electrical contact with the second battery terminal, so as to momentarily establish electrical connection between the second battery terminal and the second electrical leadwire of the light emitting device, to thereby turn on the light emitting device and illuminate the light transmissive casing, wherein the fastener hole in the cover is aligned with the mounting hole in the second protrusion of the light transmissive casing when the cover is disposed on the recessed surface and covering the first cavity and the second cavity;

a fastener configured to be received within the mounting hole for securing the cover relative to the light transmissive casing;

wherein the diameter of the first cavity is no more than 0.5 millimeters greater than the diameter of the single battery such that the single battery is snugly disposed within the first cavity and the second electrical leadwire force-fit between the first cavity sidewall and the single battery wedges the single battery within the first cavity to secure the single battery therein; and wherein the light emitting device is enclosed within the light transmissive casing beneath the cover such that no part of the light emitting device is external to the light transmissive casing, and the light emitting device is disposed within the second cavity proximate the center of the circular-shape of the light transmissive casing such that light emitted from the light emitting device is not transmitted directly to an area outside of the key casing assembly but instead is dispersed throughout the light transmissive casing and only transmitted to an area outside of the key casing assembly through the light transmissive casing and the cover.

12. The assembly of claim 11 wherein the first protrusion disposed between the first cavity and second cavity has a first side facing the first cavity and a second side facing the second cavity, wherein the first side is at an angle relative to the second side such that the first and second sides converge towards the center of the circular-shape of the light transmissive casing, to thereby form a generally prism-like shape such that light transmitted from within the second cavity though the first protrusion is dispersed throughout the light transmissive casing.

13. The assembly of claim 12 wherein the second protrusion disposed between the first cavity and second cavity has opposing sides that converge towards the center of the light transmissive casing to form a generally prism-like shape for causing dispersion of light throughout the light transmissive casing.

14. The assembly of claim 13 wherein the fastener hole is positioned approximately midway between the first and second ends of the U-shaped slot so as to define a first cross-sectional area between the fastener hole and the first end of the U-shaped slot, and a second cross-sectional area between the fastener hole and the second end of the U-shaped slot, whereby the first cross-sectional area and second cross-sectional area together are less than the cross-sectional area between the first and second ends of the U-shaped slot to thereby define an area of weakness about which the deflecting portion within the U-shaped slot is configured to be deflected inwardly towards the second battery terminal of the single battery.

15. The assembly of claim 14 wherein the light transmissive casing is made of a material that is one of an optically translucent material or an optically transparent material, such that light emitted by the light emitting device is dispersed through the light transmissive casing so that the entire light transmissive casing has an effect of being illuminated.

16. The assembly of claim 15 further comprising a key ring received within the key ring hole, wherein the key ring and slot are configured to retain a grip-end portion of a key that is received within the slot, by the key ring extending though an opening in the grip-end portion of a key that is aligned with the key ring hole.

17. The assembly of claim 16, wherein the single battery, the light emitting device and the first and second electrical leadwires are enclosed within the interior portion of the light transmissive casing, such that a grip-end portion of a key that is received within the slot is electrically isolated from the single battery, the light emitting device and the first and second electrical leadwires.

18. The assembly of claim 17 wherein the second electrical leadwire disposed within the arcuate-shaped wire slot has a length of less than about 10 millimeters that is cantilevered beyond the arcuate-shaped wire slot, such that the free end portion of the second electrical leadwire has a stiffness of at least 1.82 killipascal that is sufficient for restoring the free end of the second electrical leadwire to the first position spaced apart from the second battery terminal.

19. The assembly of claim 18 wherein the second electrical leadwire has an inertial cross-section of at least $5.2\times10^{-19}$ meters$^4$ to provide a sufficient resistance to a bending moment for restoring the free end of the second electrical leadwire to the first position spaced apart from the second battery terminal.

20. An illuminated key casing assembly for receiving a key therein, which may be selectively illuminated for improving visibility during use of the key, comprising:

a light transmissive casing made of a translucent material, the light transmissive casing having a generally circular shape with a top side, a bottom side, a key ring hole extending through the light transmissive casing from the top side to the bottom side, and a slot disposed between the top side and the bottom side that extends to the key ring hole, the slot being configured to receive a grip-end portion of a key within an open end of the slot, the light transmissive casing further comprising an interior portion that includes:

a first cavity that is disposed in the top side of the light transmissive casing having a diameter that is sized such that the first cavity is configured to snugly receive a single battery therein;

a second cavity that is disposed in the top side of the light transmissive casing near the center of the circular shape of the light transmissive casing, the second cavity being configured to receive a light emitting device therein, wherein the second cavity adjoins the first cavity and has a bottom surface therein, and the second cavity is disposed directly above the slot that is configured to receive the grip-end portion of a key therein, such that light being transmitted from within the second cavity through the bottom surface and to the slot is reflected off a surface of a key that is received within the slot, to thereby disperse light transmitted from the second cavity throughout the light transmissive casing;

a recessed surface in the top side of the light transmissive casing that extends around at least a portion of the first cavity and the second cavity;

a first protrusion disposed between the first cavity and the second cavity, wherein light that is transmitted from within the second cavity through the first protrusion is dispersed by the protrusion throughout the light transmissive casing;

a second protrusion disposed between the first cavity and the second cavity, the second protrusion having a mounting hole therein that is configured to receive a fastener, and an arcuate-shaped wire slot, said arcuate-shaped wire slot extending across the second protrusion from the first cavity to the second cavity;

a single battery disposed in the first cavity and having a diameter of a size such that the single battery is snugly received within the first cavity, the single battery having a first battery terminal on at least a side portion of the battery and a second battery terminal on a top portion of the battery;

a light emitting device disposed within the second cavity in the light transmissive casing such that the light emitting device is completely enclosed within the interior portion of the light transmissive casing, and a light emitting end of the light emitting device is positioned adjacent the first protrusion, such that a portion of light emitted by the light emitting device is transmitted into the first protrusion and dispersed throughout the light transmissive casing, the light emitting device further including a first electrical leadwire and a second electrical leadwire, wherein the first electrical leadwire is force-fit between an annular sidewall of the first cavity and the single battery snugly disposed within the first cavity so as to wedge the single battery within the first cavity, to secure and prevent movement of the single battery within the first cavity and to further establish electrical contact with the first battery terminal, and wherein the second electrical leadwire is received within the arcuate-shaped wire slot in the second protrusion, and a free end of the second electrical leadwire extends in a cantilevered manner beyond the second protrusion to a first position in which the end of the second electrical leadwire is positioned over the top of the single battery so as to be spaced apart from the second battery terminal;

a cover disposed on the recessed surface and covering the first cavity and the second cavity such that the light emitting device is completely enclosed within the interior portion of the light transmissive casing, the cover abutting the second protrusion on the light transmissive casing so as to entrap the second electrical leadwire between the cover and the light transmissive casing and rigidly secure the second electrical leadwire within the arcuate-shaped wire slot in the second protrusion, the cover further including a U-shaped slot having first and second ends, and a fastener hole that is positioned at an approximately equal distance from both the first and second ends of the U-shaped slot so as to define an area of weakness about which a deflecting portion within the U-shaped slot is configured to be selectively depressed and deflected inwardly to push the free end of the second electrical leadwire into electrical contact with the second battery terminal, so as to momentarily establish electrical connection between the second battery terminal and the second electrical leadwire of the light emitting device, to thereby turn on the light emitting device and illuminate the light transmissive casing, wherein the fastener hole in the cover is aligned with the mounting hole in the second protrusion of the light transmissive casing when the cover is disposed on the recessed surface and covering the first cavity and the second cavity; and a fastener configured to be received within the mounting hole for securing the cover relative to the light transmissive casing;

wherein the diameter of the first cavity is no more than 0.5 millimeters greater than the diameter of the single battery such that the single battery is snugly disposed within the first cavity and the second electrical leadwire force-fit between the first cavity sidewall and the single battery wedges the single battery within the first cavity to secure the single battery therein; and wherein the light emitting device is enclosed within the light transmissive casing beneath the cover such that no part of the light emitting device is external to the light transmissive casing, and the light emitting device is disposed within the second cavity proximate the center of the circular-shape of the light transmissive casing such that light emitted from the light emitting device is not transmitted directly to an area outside of the key casing assembly but instead is dispersed throughout the light transmissive casing and only transmitted to an area outside of the key casing assembly through the light transmissive casing and the cover; and wherein the first protrusion is configured to have opposing sides that converge towards the center of the light transmissive casing to form a generally prism-like shape for causing dispersion of light, so that light emitted by the light emitting device is not transmitted directly through the light transmissive casing to an area outside of the illuminated key casing assembly but instead is dispersed by the first protrusion, to thereby disperse light emitted by the light emitting device throughout the light transmissive casing.

* * * * *